US008888261B2

(12) United States Patent
Katsuragi

(10) Patent No.: US 8,888,261 B2
(45) Date of Patent: Nov. 18, 2014

(54) IMAGE FORMING METHOD, PRETREATMENT LIQUID SET, AND CARTRIDGE

(75) Inventor: Koji Katsuragi, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 565 days.

(21) Appl. No.: 13/090,578

(22) Filed: Apr. 20, 2011

(65) Prior Publication Data

US 2011/0279517 A1 Nov. 17, 2011

(30) Foreign Application Priority Data

May 14, 2010 (JP) ..... 2010-111807

(51) Int. Cl.
*B41J 2/01* (2006.01)
*B41J 2/21* (2006.01)

(52) U.S. Cl.
CPC ..... *B41J 2/2114* (2013.01); *B41J 2/2107* (2013.01)
USPC ..... 347/96; 347/100; 347/95

(58) Field of Classification Search
USPC ..... 347/95, 96, 101, 100, 21, 20, 9, 88, 99; 106/31.13, 31.631, 27; 523/160, 161
See application file for complete search history.

(56) References Cited

U.S. PATENT DOCUMENTS

| | | | | |
|---|---|---|---|---|
| 7,128,413 | B2 * | 10/2006 | Yoshimura et al. | 347/105 |
| 2003/0073779 | A1 * | 4/2003 | Tamori et al. | 524/588 |
| 2005/0191441 | A1 * | 9/2005 | Yamamoto et al. | 428/32.24 |
| 2007/0003714 | A1 * | 1/2007 | Nakano et al. | 428/32.28 |
| 2008/0119628 | A1 * | 5/2008 | Wada et al. | 528/45 |
| 2009/0202753 | A1 * | 8/2009 | Teramae et al. | 428/32.2 |

FOREIGN PATENT DOCUMENTS

| | | |
|---|---|---|
| JP | 2004-9463 | 1/2004 |
| JP | 4136814 | 6/2008 |
| JP | 2009-66852 | 4/2009 |
| JP | 2010-131779 | 6/2010 |
| WO | WO 2004/026976 A1 | 4/2004 |

* cited by examiner

*Primary Examiner* — Manish S Shah
(74) *Attorney, Agent, or Firm* — Oblon, Spivak, McClelland, Maier & Neustadt, L.L.P.

(57) ABSTRACT

To provide an image forming method, which contains: treating a surface of a recording medium with acid, an oxazoline group-containing polymer, and adipic acid dihydrazide.

10 Claims, 6 Drawing Sheets

IMAGE FORMING METHOD, PRETREATMENT LIQUID SET, AND CARTRIDGE

BACKGROUND OF THE INVENTION

1. Field of the Invention

The present invention relates to an image forming method, a pretreatment liquid used in such method, and a cartridge housing such pretreatment liquid set therein.

2. Description of the Related Art

It has been proposed in the conventional art that a first liquid and a second liquid are mixed on a recording medium to induce aggregations of a polyvalent metal salt and a pigment, and a crosslink reaction between adipic acid dihydrazide and polyvinyl alcohol or a water-soluble polymer at the same time to thereby improve fixation of an ink (see International Patent Application Publication No. WO 04/026976, and Japanese Patent (JP-B) No. 4136814).

Between the aggregation reaction and the crosslink reaction, speed of the aggregation reaction is a lot faster then the crosslink reaction, and thus this proposal is not effective for attaining abrasion resistance just after printing.

The present inventors have proposed an image forming method in which as a pretreatment liquid, acid and an oxazoline group-containing polymer are applied to a recording medium before ejecting an aqueous recording ink onto the recording medium (see Japanese Patent Application Laid-Open (JP-A) No. 2010-131779). The technique of this proposal achieved improvements in both image density and fixing ability. However, this proposed technique clearly improved the fixing ability compared to the case where only acid was applied, but the fixing ability was poor compared to the case where the pretreatment liquid was not applied at all.

Accordingly, it is a current situation that there is a strong demand for an image forming method which realizes both high image quality and fixing ability in high speed printing by a liquid ejecting device, as well as a pretreatment liquid set used in such method, and a cartridge housing such pretreatment liquid.

BRIEF SUMMARY OF THE INVENTION

The present invention aims at solving the various problems in the art, and achieving the following object. An object of the present invention is to provide an image forming method which achieves both formations of high quality images and desirable fixation of an ink by means of a liquid ejecting device in high speed printing, and to provide a pretreatment liquid set used in such method and a cartridge housing such pretreatment liquid set therein.

Means for solving the aforementioned problems are as follows:

<1> An image forming method, containing:

treating a surface of a recording medium with acid, an oxazoline group-containing polymer, and adipic acid dihydrazide.

<2> The image forming method according to <1>, wherein the treating is treating the surface of the recording medium with a first pretreatment liquid containing the acid and the oxazoline group-containing polymer, and with a second pretreatment liquid containing the adipic acid dihydrazide, and wherein the method further contains:

ejecting an aqueous recording ink from a liquid ejecting device to form an image on the surface of the recording medium.

<3> The image forming method according to <1>, wherein the treating contains: treating the surface of the recording medium with a first pretreatment liquid containing the acid and the oxazoline group-containing polymer; and ejecting an aqueous recording ink containing the adipic acid dihydrazide from a liquid ejecting device to form an image on the surface of the recording medium.

<4> The image forming method according to any one of <1> to <3>, wherein an amount of the adipic acid dihydrazide for use is 0.2 mol or more relative to 1 mol of oxazoline groups contained in the oxazoline group-containing polymer.

<5> The image forming method according to any one of <1> to <4>, wherein an amount of the oxazoline group-containing polymer for use is determined based on an amount of oxazoline groups contained therein, which is 0.5 mol or less relative to 1 mol of the acid.

<6> The image forming method according to any one of <1> to <5>, wherein the acid contains a carboxyl group in a molecular structure thereof.

<7> The image forming method according to <6>, wherein the acid is lactic acid.

<8> The image forming method according to <2>, wherein the first pretreatment liquid, the second pretreatment liquid, or both thereof further contains a surfactant.

<9> The image forming method according to <8>, wherein the surfactant is a fluorosurfactant.

<10> The image forming method according to <9>, wherein the fluorosurfactant is a compound expressed by the following formula (1).

$$C_4F_9—CH_2CH(OH)CH_2O—(CH_2CH_2O)_{23}—CH_2CH(OH)CH_2—C_4F_9 \quad \text{Formula (1)}$$

<11> The image forming method according to any of <2>, <8>, <9> or <10>, wherein the first pretreatment liquid, the second pretreatment liquid, or both thereof further contains a foam inhibitor.

<12> The image forming method according to <11>, wherein the foam inhibitor is at least one selected from the group consisting of N-octyl-2-pyrrolidone, 2,4,7,9-tetramethyldecane-4,7-diol, and 2,5,8,11-tetramethyldodecane-5,8-diol.

<13> A pretreatment liquid set, containing:

a first pretreatment liquid containing acid and an oxazoline group-containing polymer; and a second pretreatment liquid containing adipic acid dihydrazide, wherein the pretreatment liquid set is used in an image forming method, which contains:

treating a surface of a recording medium with the first pretreatment liquid and the second pretreatment liquid; and ejecting an aqueous recording ink from a liquid ejecting device to form an image on the surface of the recording medium.

<14> The pretreatment ink set according to <13>, wherein the acid is lactic acid.

<15> The pretreatment ink set according to any one of <13> to <14>, wherein the first pretreatment liquid, the second pretreatment liquid, or both thereof further contains a surfactant.

<16> The pretreatment ink set according to any one of <13> to <15>, wherein the first pretreatment liquid, the second pretreatment liquid, or both thereof further contains a foam inhibitor.

<17> A cartridge, containing:

a container;

a pretreatment liquid set housed in the container, wherein the pretreatment liquid set contains:

a first pretreatment liquid containing acid and an oxazoline group-containing polymer; and a second pretreatment liquid containing adipic acid dihydrazide, wherein the pretreatment liquid set is used in an image forming method, which contains:

treating a surface of a recording medium with the first pretreatment liquid and the second pretreatment liquid; and ejecting an aqueous recording ink from a liquid ejecting device to form an image on the surface of the recording medium.

<18> The cartridge according to <17>, wherein the acid is lactic acid.

<19> The cartridge according to any one of <17> to <18>, wherein the first pretreatment liquid, the second pretreatment liquid, or both thereof further contains a surfactant.

<20> The cartridge according to any one of <17> to <19>, wherein the first pretreatment liquid, the second pretreatment liquid, or both thereof further contains a foam inhibitor.

The present invention solves the various problems in the art, and achieves the following object. Namely, the present invention provides: an image forming method which achieves both formations of high quality images and desirable fixation of an ink by means of a liquid ejecting device in high-speed printing; a pretreatment liquid set used in such method; and a cartridge housing such pretreatment liquid set therein.

Figure 1:
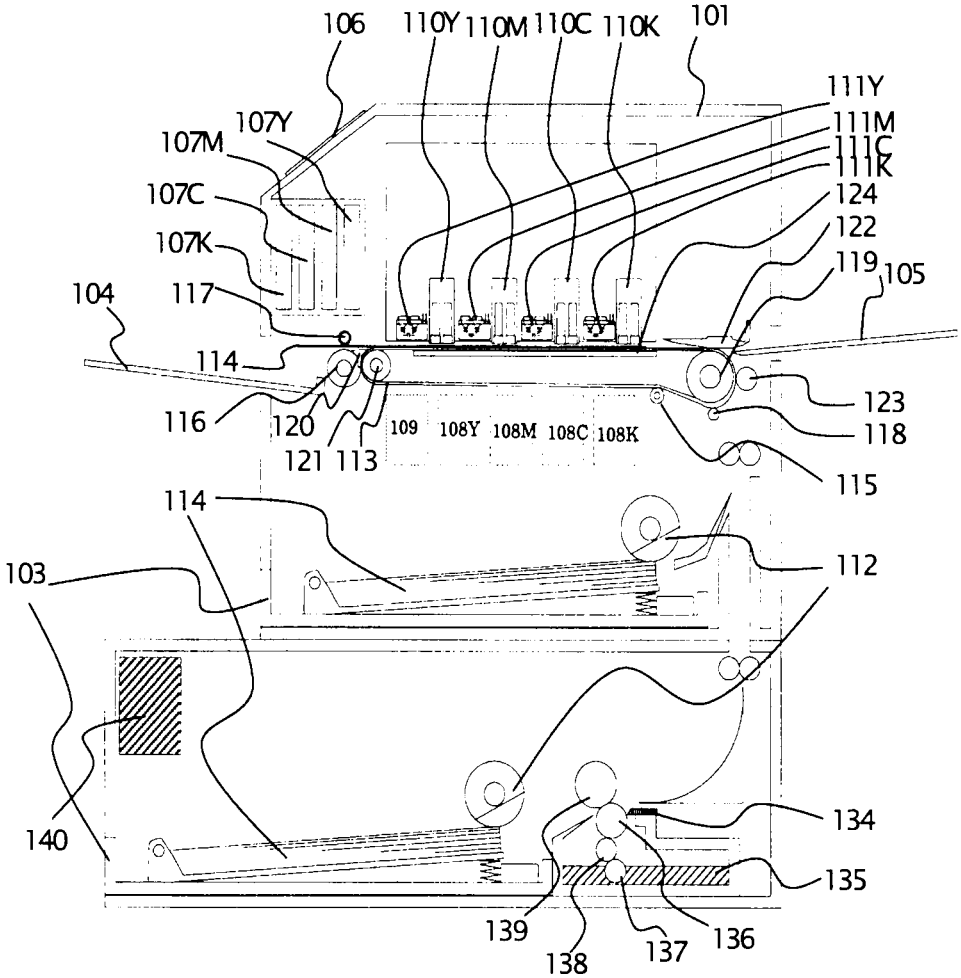
FIG. 1 is a schematic diagram (a side view explanatory diagram) showing one example of an image forming device.

DETAILED DESCRIPTION OF THE INVENTION (Image Forming Method)

The image forming method of the present invention contains treating a surface of a recording medium with acid, an oxazoline group-containing polymer, and adipic acid dihydrazide.

The image forming method preferably contains: treating the surface of the recording medium with a first pretreatment liquid containing the acid and the oxazoline group-containing polymer, and a second pretreatment liquid containing the adipic acid dihydrazide; and ejecting an aqueous recording ink by means of a liquid ejecting device to form an image on the surface of the recording medium.

Moreover, the image forming method preferably contains: treating the surface of the recording medium with the first pretreatment liquid containing the acid and the oxazoline group-containing polymer; and ejecting an aqueous recording ink containing the adipic acid dihydrazide to form an image on the surface of the recording medium.

Use of the conventional pretreatment liquid containing acid with an ink composition containing a coloring agent encapsulated in a carboxyl group-containing resin, which is the conventional combination, causes aggregations of pigments (the coloring agent) on a recording medium due to the acid and the carboxyl group. As a result of this, images of high density and high image quality can be obtained, but the aggregated pigment cannot be fixed onto the recording medium, which may cause smear of the transferred unfixed pigment on a transfer roller or the like, especially during high-speed transfer in a line-engine system. There is a method in which acid and oxazoline are added to a pretreatment liquid, and a crosslink reaction of the acid and oxazoline groups are used. However, in this method, fixation of an ink is insufficient, which often causes the similar problems such that a transfer roller or the like is smeared with the transferred pigment.

In the present invention, therefore, a crosslinked product obtained by a crosslink reaction between the acid and the oxazoline group is allowed to react with adipic acid dihydrazide, to thereby form a second crosslinked product that has higher crosslinking degree, and higher molecular weight than the original crosslinked product. As a result, both high image quality and desirable fixing ability can be attained in the present invention.

<Pretreatment Liquid>

The first pretreatment liquid is applied to a recording medium prior to the deposition of the ejected aqueous recording ink thereon, and the first pretreatment liquid contains at least the acid and the oxazoline group-containing polymer, and may further contain other substances, if necessary.

The adipic acid dihydrazide may be added into the second pretreatment liquid, or added into an aqueous recording ink.

—Acid—

The acid is suitably selected depending on the intended purpose without any restriction. The acid is preferably acid having a carboxyl group in a molecular structure thereof, and more preferably an organic acid having a carboxyl group in a molecular structure thereof. Organic acids are produced in the body or contained in food products, and do not accumulate in the human body. Also, many of them are odorless, making them desirable for use in image forming apparatuses in home and office. As the organic acid having the carboxyl group in a molecular structure thereof, succinic acid, citric acid, malic acid, tartaric acid, lactic acid, and ammonium lactate are preferable, and lactic acid is particularly preferable.

The acid plays two roles, namely the acid is used for a crosslinking reaction with the oxazoline group-containing polymer contained in the first pretreatment liquid, and is used to react with the carboxyl group-containing resin contained in the aqueous recording ink to aggregate particles of the pigment contained in the ink above a recording medium.

The amount of the acid for use is appropriately selected depending on the intended purpose without any restriction. The amount of the acid is preferably 2 mol or more relative to 1 mol of oxazoline groups contained in the oxazoline group-containing polymer. This is because the acid plays two roles as mentioned earlier, and if the entire acid is used for a crosslink reaction with the oxazoline group-containing polymer, which occurs first, a reaction cannot be occurred later with the carboxyl group-containing resin. However, when the amount of the acid in the first pretreatment liquid is excessively large, the effect of aggregating the pigment by the reaction of the acid with the carboxyl group-containing resin contained in the aqueous recording ink is so strong that a diameter of a resulting dot recorded with the ink on a recording medium is small. This phenomenon shows that the dot of the ink is insufficiently spread on a recording medium. If this insufficient spread occurs especially in a solid image portion, a problem is caused such that a base color of the recording medium influences the formed image. Therefore, the amount of the acid for use in the first pretreatment liquid is optimized in the range which would not cause problems in a resulting image, and the amount thereof is preferably 20% by mass or less, more preferably 10% by mass or less relative to the total amount of the first pretreatment liquid.

—Oxazoline Group-Containing Polymer—

The oxazoline group-containing polymer is added for improving fixation of an ink. Examples of the oxazoline group-containing polymer include a resin having oxazoline groups in the structure thereof; and particles on each surface of which oxazoline groups are adsorbed.

Commercial products of the resin having oxazoline groups are available. Examples of such commercial products include acryl-styrene resins of K-2000 series, acrylic resins of WS series, styrene resins of RPS series, and acrylonitrile-styrene resins of RAS series, all manufactured by Nippon Shokubai Co., Ltd.

The particles on each surface of which the oxazoline groups have been adsorbed are also commercially available. The particles on each surface of which the oxazoline groups have been adsorbed may be organic particles or inorganic particles. Examples of such organic particles include ME series manufactured by Soken Chemical & Engineering Co., Ltd., JURYMER MB series manufactured by Toagosei Co., Ltd., TODPEARL series manufactured by Momentive Performance Materials Inc., Microgel series manufactured by Nippon Paint Co., Ltd., and FLUON series manufactured by ASAHI GLASS CO., LTD. Examples of the inorganic particles include titania series manufactured by Idemitsu Kosan Co., Ltd., and aluminum oxide C manufactured by Nippon Aerosil Co., Ltd.

The amount of the oxazoline group-containing polymer for use is suitably adjusted depending on the intended purpose without any restriction. The amount of the oxazoline group-containing polymer is determined as an amount of the oxazoline groups in the oxazoline group-containing polymer, and the amount thereof is preferably 0.5 mol or less, more preferably 0.25 mol or less relative to 1 mol of the acid. The amount of the oxazoline group-containing polymer is optimized so as not to use all the acid in the crosslink reaction in the first pretreatment liquid, and to prevent the first pretreatment liquid from being solidified by the crosslink reaction before applied on a recording medium. Moreover, when the amount of the oxazoline groups contained in the oxazoline group-containing polymer is more than 0.5 mol relative to 1 mol of the acid, fixing ability of an ink tends to decrease more than the case without using the oxazoline group-containing polymer on a recording medium.

The mixing method of the acid and the oxazoline group-containing polymer is suitably selected depending on a coating method, a storage method, and the like. The acid and the oxazoline group-containing polymer may be mixed to prepare the first pretreatment liquid. Alternatively, the acid and the oxazoline group-containing polymer, each of which are separately prepared, are separately ejected at the time of the coating to a recording medium, and are mixed on the recording medium to thereby allow them to function as the first pretreatment liquid.

—Adipic Acid Dihydrazide—

The adipic acid dihydrazide is used for the purpose of improving fixation of an ink. A mechanism of improving the fixation is that the acid and the oxazoline group-containing polymer are allowed to carry out a crosslinking reaction to thereby form amide ester, and the adipic acid dihydrazide is then allowed to react with such amide ester to thereby generate a second crosslinked material from the amide ester as a starting material. This second crosslinked material is formed by further crosslinking a material which has been already crosslinked once, and thus it is a material having higher crosslink density and high molecular weight. As the crosslink density of the material is higher, more likely that particles of the pigment aggregated by the acid are retained on a crosslinked layer present on a surface of a recording medium, and abrasion resistance improves owing to the high crosslink density and high molecular weight thereof.

The adipic acid dihydrazide may be added to the second pretreatment liquid, or to the aqueous recording ink, provided that it is added after amide ester is generated from a reaction between the acid and the oxazoline group-containing polymer.

An amount of the adipic acid dihydrazide for use is appropriately adjusted depending on the intended purpose without any restriction, but it is preferably 0.2 mol or more relative to 1 mol of oxazoline groups contained in the oxazoline group-containing polymer. When the amount thereof is 0.2 mol or more, fixation of an ink would be sufficiently improved by an effect of the second crosslinked material. When the amount thereof is less than 0.2 mol, the effect of the second crosslinked material may not be sufficiently obtained.

—Other Components—

Other components contained in the pretreatment liquid are a surfactant, a foam inhibitor, water, a water-soluble organic solvent, and the like. Among them, the surfactant, and the foam inhibitor are preferable.

—Surfactant—

The first pretreatment liquid, or the second pretreatment liquid, or both thereof preferably contains a surfactant for reducing surface tension of the pretreatment liquid. One of the desirable properties of the pretreatment liquid is appropriate wettability to various types of recording media, or even ejection or coating. By making the pretreatment liquid appropriately wettable, a penetrating speed of the pretreatment liquid to various recording media can be increased, which can improves abrasion resistance or prevent bleeding. Especially, the penetrating ability of the pretreatment liquid to various recording media is important. If the pretreatment liquid has low penetrating ability, a large amount of the pretreatment liquid is retained adjacent to a surface of a recording medium. When this retained pretreatment liquid is in contact with the aqueous recording ink containing the coloring agent on the recording medium, the carboxyl group-containing resin encapsulating the coloring agent pretreatment liquid causes excessive aggregations, which causes insufficient filling of a solid image due to reduction in diameters of formed dots. Moreover, as substances of the coloring agent are retained on the surface of the recording medium in the excessive amount, a problem such as poor abrasion resistance or the like is caused.

For the reasons mentioned above, the surfactant is generally added to the pretreatment liquid to reduce a surface tension thereof. Among the surfactants generally used, a fluoroalkyl group-containing surfactant (a fluorosurfactant) is preferable because it has an ability to significantly reduce a surface tension when it is dissolved in water. Specifically, the compound expressed by the following formula (1) is particularly preferable as the surfactant for use.

$$C_4F_9—CH_2CH(OH)CH_2O—(CH_2CH_2O)_{23}—CH_2CH(OH)CH_2—C_4F_9 \quad \text{Formula (1)}$$

The compound expressed by the formula (1) does not contain perfluorooctane sulfonate (PFOS) and perfluorooctanoic acid (PFOA), and therefore it is also excellent in view of environmental friendliness.

However, the compound expressed by the formula (1) has extremely high surface activities. When this compound is used alone, it forms air bubbles significantly, which do not disappear even through a defoaming agent is added as in the conventional manner. Therefore, it is preferred that a foam inhibitor be added to the pretreatment liquid to suppress foaming.

—Foam Inhibitor—

The foam inhibitor is suitably selected depending on the intended purpose without any restriction, but at least one selected from the group consisting of N-octyl-2-pyrrolidone, 2,4,7,9-tetramethyldecane-4,7-diol, and 2,5,8,11-tetramethyldodecane-5,8-diol is preferable as the foam inhibitor. By using any of these foam inhibitors in combination with the compound expressed by the formula (1), generation of bubbles can be suppressed, which as a result prevents any problem may caused by the bubbles.

Surface tension of each of the first pretreatment liquid and the second pretreatment liquid is determined by a ratio between the fluorosurfactant and the foam inhibitor. In the case where surface tension of the pretreatment liquid needs to be low to respond to a recording medium for use, the ratio of the fluorosurfactant is increased. Naturally, as the ratio of the fluorosurfactant increases, problems related to foaming occur. For this reason, the ratio of the fluorosurfactant is preferably 40% by mass or lower, more preferably 30% by mass or lower relative to the total amount of the fluorosurfactant and the foam inhibitor.

The total amount of the fluorosurfactant and the foam inhibitor contained in the first or second pretreatment liquid is preferably 2% by mass or lower, more preferably 1% by mass or lower relative to the total amount of the first or second pretreatment liquid.

The first pretreatment liquid, or the second pretreatment liquid may contain water or a water-soluble organic solvent as a solvent.

—Water-Soluble Organic Solvent—

The water-soluble organic solvent is suitably selected depending on the intended purpose without any restriction. Examples thereof include polyhydric alcohols, polyhydric alcohol alkyl ethers, polyhydric alcohol aryl ethers, nitrogen-containing heterocyclic compounds, amides, amines, sulfur-containing compounds, propylene carbonates, and ethylene carbonates.

Examples of the polyhydric alcohols include glycerin, 1,3-butanediol, 3-methyl-1,3-butanediol, 1,5-pentanediol, 1,6-hexanediol, ethylene glycol, diethylene glycol, triethylene glycol, tetraethylene glycol, polyethylene glycol, propylene glycol, dipropylene glycol, tripropylene glycol, polypropylene glycol, hexylene glycol, trimethylol ethane, trimethylol propane, glycerol, 1,2,3-butanetriol, 1,2,4-butanetriol, 1,2,6-hexanetriol, and petriol.

Examples of the polyhydric alcohol alkyl ethers include ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether.

Examples of the polyhydric aryl ethers include ethylene glycol monophenyl ether, and ethylene glycol monobenzyl ether.

Examples of the amines include monoethanol amine, diethanol amine, triethanol amine, monoethyl amine, diethyl amine, and triethyl amine.

Examples of the sulfur-containing compounds include dimethyl sulfoxide, sulfolane, and thiodiethanol.

Among these water-soluble organic solvent, glycerin, diethylene glycol, 1,3-butanediol, and 3-methyl-1,3-butanediol are particularly preferable. These water-soluble organic solvents have excellent effects of dissolubility, and prevention of jetting failures due to moisture evaporation. Moreover, these water-soluble organic solvents contribute to prepare a pretreatment liquid having excellent storage stability and jetting stability.

<Aqueous Recording Ink>

The aqueous recording ink is suitably selected depending on the intended purpose without any restriction, but it is preferably an aqueous recording ink, which contains at least a coloring agent, a water-soluble organic solvent, a surfactant, and water, and optionally contain other substances such as a carboxyl group-containing resin. In the case where adipic acid dihydrazide is not added to the second pretreatment liquid, the aqueous recording ink may contain adipic acid dihydrazide.

—Coloring Agent—

The coloring agent may be selected from conventional dyes or pigments that are commonly used in aqueous recording inks. Moreover, coloring agent particles in which inorganic particles are each coated with an organic pigment or carbon black may be used as the coloring agent.

Examples of the method for covering each of the inorganic particles with carbon black include: a method of drying in liquid by deposition, precipitation, or the like; a drying-mixing method in which a mechanical force is applied while mixing. Examples of the method of coating each inorganic particle with an organic pigment include: a method in which an organic pigment is precipitated in presence of inorganic particles; and a method in which inorganic particles and an organic pigment are mechanically mixed and ground. If inorganic particles are coated with an organic pigment that is excellent in thermal stability, chemical deposition can be used for coating. Moreover, if necessary, an organosilane compound layer formed by polysiloxane or alkyl silane can be provided between an inorganic particle and an organic pigment, so that adhesion between the inorganic particle and the organic pigment can be improved.

The inorganic particles are suitably selected depending on the intended purpose without any restriction. Examples of the inorganic particles include titanium dioxide, silica, alumina, iron oxide, iron hydroxide, and tin oxide. Regarding a shape of the inorganic particle, those having a small aspect ratio are preferable, and those having spherical shapes are particularly preferable. In the case where a color coloring agent is adsorbed on a surface of the inorganic particle, the inorganic particle is preferably clear with no tint, or white. Black inorganic particles may be used when a black coloring agent is adsorbed on a surface of each inorganic particle.

A primary particle diameter of the inorganic particle is preferably 100 nm or smaller, more preferably 5 nm to 50 nm.

The organic pigment for coating the inorganic particles is suitably selected depending on the intended purpose without any restriction. Examples of the black organic pigment for use include aniline black. Examples of the color organic pigment for use include anthraquinone, phthalocyanine blue, phthalocyanine green, diazo, monoazo, pyranthrone, perylene, heterocyclic yellow, quinacridon, and (thio)indigo.

Among them, the phthalocyanine pigment, quinacridon pigment, monoazo yellow pigment, diazo yellow pigment, and heterocyclic yellow pigment are particularly preferable in view of their coloring properties.

Examples of the phthalocyanine pigment include copper phthalocyanine blue or a derivative thereof (C.I. Pigment Blue 15:3, and C.I. Pigment Blue 15:4), and aluminum phthalocyanine.

Examples of the quinacridon pigment include C.I. Pigment Orange 48, C.I. Pigment Orange 49, C.I. Pigment Red 122, C.I. Pigment Red 192, C.I. Pigment Red 202, C.I. Pigment Red 206, C.I. Pigment Red 207, C.I. Pigment Red 209, C.I. Pigment Violet 19, and C.I. Pigment Violet 42.

Examples of the monoazo yellow pigment include C.I. Pigment Yellow 74, C.I. Pigment Yellow 109, C.I. Pigment Yellow 128, and C.I. Pigment Yellow 151.

Examples of the diazo yellow pigment include C.I. Pigment Yellow 14, C.I. Pigment Yellow 16, and C.I. Pigment Yellow 17.

Examples of the heterocyclic yellow pigment include C.I. Pigment Yellow 117, and C.I. Pigment Yellow 138.

The weight ratio of the inorganic particles to the coloring agent that is the organic pigment or carbon black (the weight of the inorganic particles/the weight of the coloring agent) is preferably 3/1 to 1/3, more preferably 3/2 to 1/2. When the ratio of the coloring agent is too small, coloring performance or coloration ability thereof may decrease. When the ratio of the coloring agent is excessively large, a resulting ink may have low transparency or undesirable color tone.

Examples of commercial products of coloring agent particles in which the inorganic particles are each coated with the organic pigment or carbon black include a silica/carbon black composite material, a silica/phthalocyanine C.I. Pigment Blue 15:3 composite material, a silica/diazo yellow composite material, and a silica/quinacridon C.I. Pigment Red 122 composite material, all manufactured by Toda Kogyo Corp. These materials have small primary particle diameters, and hence they can be suitably used.

For example, if inorganic pigments each having a primary particle diameter of 20 nm are coated with an equal amount of an organic pigment, the coated particles will each have a primary diameter of approximately 25 nm. Therefore, provided that these particles are dispersed maintaining the state of primary particles by using an appropriate dispersing agent, an extremely finely dispersed pigment ink having a dispersed particle diameter of 25 nm can be obtained.

The primary particle diameters of the coloring agent particles are suitably selected depending on the intended purpose without any restriction, but they are preferably 5 nm to 100 nm, more preferably 30 nm to 80 nm in the aqueous recording ink. When the primary particle diameter thereof is smaller than 5 nm, the resulting ink may increase in viscosity after a long period of storage, or the coloring agent particles may cause aggregations. When the primary particle diameter thereof is larger than 100 nm, in the case where the resulting ink is used to print on a medium such as a piece of paper or a film, the obtained print may have a printed portion which has low color saturation and brightness. Note that, the primary particle diameter of the coloring agent particles means a minimum unit for the coloring agent particle that cannot be mechanically pulverized any smaller.

An amount of the coloring agent particles in the aqueous recording ink is suitably selected depending on the intended purpose without any restriction, but it is preferably 1% by mass to 20% by mass, more preferably 2% by mass to 15% by mass.

—Water-Soluble Organic Solvent—

The aqueous recording ink in the present invention uses water as a solvent, but may further contain a water-soluble organic solvent in combination for the purposes of, for example, preventing the ink from being dried and increasing dispersion stability. As the water-soluble organic solvent, two or more thereof may be used in combination.

Examples of the water-soluble organic solvent include polyhydric alcohols, polyhydric alcohol alkyl ethers, polyhydric alcohol aryl ethers, nitrogen-containing heterocyclic compounds, amides, amines, sulfur-containing compounds, propylene carbonates, and ethylene carbonates.

Examples of the polyhydric alcohols include glycerin, 1,3-butanediol, 3-methyl-1,3-butanediol, 1,5-pentanediol, 1,6-hexanediol, ethylene glycol, diethylene glycol, triethylene glycol, tetraethylene glycol, polyethylene glycol, propylene glycol, dipropylene glycol, tripropylene glycol, polypropylene glycol, hexylene glycol, trimethylol ethane, trimethylol propane, glycerol, 1,2,3-butane triol, 1,2,4-butane triol, 1,2,6-hexane triol, and petriol.

Examples of the polyhydric alcohol alkyl ethers include ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether.

Examples of the polyhydric alcohol aryl ethers include ethylene glycol monophenyl ether, and ethylene glycol monobenzyl ether.

Examples of the nitrogen-containing compounds include 2-pyrrolidone, N-methyl-2-pyrrolidone, N-hydroxyethyl-2-pyrrolidone, 1,3-dimethyl imidazolidinone, ε-caprolactam, and γ-butyrolactone.

Examples of the amines include monoethanol amine, diethanol amine, triethanol amine, monoethyl amine, diethyl amine, and triethyl amine.

Examples of the sulfur-containing compounds include dimethyl sulfoxide, sulfolane, and thiodiethanol.

Among these water-soluble organic solvents, glycerin, diethylene glycol, 1,3-butanediol, and 3-methyl-1,3-butanediol are particularly preferable. These have excellent solubility and exhibit excellent effect of preventing jetting failures due to moisture evaporation. Moreover, use of these water-soluble solvents provides an aqueous recording ink having excellent storage stability and jetting stability.

The formulation ratio of the colorant particles and the water-soluble organic solvent strongly affect stability of ink jetted from heads. If the amount of the water-soluble organic solvent is smaller than the solid content of the pigment, moisture evaporation is encouraged around the ink meniscus of nozzles, which causes jetting failures.

—Surfactant—

The surfactant is appropriately selected depending on the intended purpose without any restriction, provided that it does not adversely affect dispersion stability of the ink when used in combination with a colorant, a wetting agent or a penetrating agent. In the case where the aqueous recording ink is used for printing on a printing paper, a fluorosurfactant or silicone surfactant having low surface tension and high leveling property is preferable, and the fluorosurfactant is particularly preferable.

As the fluorosurfactant, for example, a perfluoroalkyl sulfonic acid compound, a perfluoroalkyl carboxylic acid compound, a perfluoroalkyl phosphate compound, a perfluoroalkyl ethylene oxide adduct, and a polyoxyalkylene ether polymer compound having a perfluoroalkyl ether group in the side chain thereof are particularly preferable, as they have little foamability.

Examples of the perfluoroalkyl sulfonic acid compound include perfluoroalkyl sulfonic acids, and perfluoroalkyl sulfonic acid salts.

Examples of the perfluoroalkyl carboxylic acid compound include perfluoroalkyl carboxylic acids, and perfluoroalkyl carboxylic acid salts.

Examples of the perfluoroalkyl phosphate compound include perfluoroalkyl phosphates and perfluoroalkyl phosphate salts.

Examples of the polyoxyalkylene ether polymer compound having a perfluoroalkyl ether group in the side chain thereof include sulfuric acid ester salts of polyoxyalkylene ether polymer having a perfluoroalkyl ether group in the side chain thereof, and salts of polyoxyalkylene ether polymer having a perfluoroalkyl ether group in the side chain thereof.

Examples of the counter ion in the salts in these fluorosurfactants include Li, Na, K, $NH_4$, $NH_3CH_2CH_2OH$, $NH_2(CH_2CH_2OH)_2$ and $NH(CH_2CH_2OH)_3$.

The fluorosurfactant may be selected those appropriately synthesized or commercial products. Examples of the commercial products include: SURFLON series manufactured by ASAHI GLASS CO., LTD (S-111, S-112, S-113, S-121, S-131, S-132, S-141 and S-145); FLUORAD series manufactured by Sumitomo 3M Limited (FC-93, FC-95, FC-98, FC-129, FC-135, FC-170C, FC-430 and FC-431), MEGAFAC series manufactured by DIC Corporation (F-470, F-1405 and F-474); Zonyl TBS, FSP, FSA, FSN-100, FSN, FSO-100, FSO, FS-300 and UR, manufactured by DuPont; FT-110, FT-250, FT-252, FT-400S, FT-150 and FT-400SW, manufactured by NEOS COMPANY LIMITED; and PF-151N manufactured by Omnova Solutions, Inc. Among them, from the viewpoints of improving printing quality, especially, coloring properties and level dying, particularly preferred are FT-110, FT-250, FT-252, FT-400S, FT-150 and FT-400SW (manufactured by NEOS COMPANY LIMITED) and PF-151N (manufactured by Omnova Solutions, Inc.).

The silicone surfactant is suitably selected depending on the intended purpose without any restriction. Particularly, silicone surfactants which do not decompose in the high pH condition are preferable. Examples thereof include side chain-modified polydimethylsiloxanes, both terminal-modified polydimethylsiloxane, one terminal-modified polydimethylsiloxane, and side chain and both terminal-modified polydimethylsiloxane. Among them, those having, as a modified group, a polyoxyethylene group or polyoxyethylene polyoxypropylene group are particularly preferable, since they have excellent properties as an aqueous surfactant.

The silicone surfactant may be selected from those appropriately synthesized, or commercial products. As the commercially available products, for example, silicone surfactants manufactured by BYK-Chemie Co., Shin-Etsu Chemical Co., Ltd., and Dow Corning Toray Co., Ltd. are readily available.

Moreover, as the silicone surfactant, a polyether-modified silicone surfactant can be used, and examples thereof include compounds in which a polyalkylene oxide structure is introduced into the Si-containing side chain of dimethyl siloxane The polyether-modified silicone compound may be selected from appropriately synthesized compounds or commercial products. Examples of the commercial products include KF-618, KF-642 and KF-643, all of which are manufactured by Shin-Etsu Chemical Co., Ltd.

Other than the fluorosurfactant and silicone surfactant, an anionic surfactant, a nonionic surfactant, an amphoteric surfactant and the like may be used.

Examples of the anionic surfactant include acetic acid salts of polyoxyethylene alkyl ethers, dodecylbenzene sulfonic acid salts, succinic acid ester sulfonic acid salts, lauric acid salts, and salts of polyoxyethylene alkyl ether sulfates.

Examples of the nonionic surfactant include acetylene glycol surfactants, polyoxyethylene alkyl ethers, polyoxyethylene alkyl phenyl ethers, polyoxyethylene alkyl esters, and polyoxyethylene sorbitan fatty acid esters.

Examples of the acetylene glycol surfactant include 2,4,7,9-tetramethyl-5-decyn-4,7-diol, 3,6-dimethyl-4-octyn-3,6-diol, and 3,5-dimethyl-1-hexyn-3-diol. Moreover, examples of commercially available products thereof include SURFYNOL series manufactured by Air Products and Chemicals, Inc. (104, 82, 465, 485 and TG).

Examples of the amphoteric surfactant include lauryl amino propionic acid salts, lauryl dimethyl betaine, stearyl dimethyl betaine, lauryl dihydroxyethyl betaine, lauryl dimethyl amine oxide, myristyl dimethyl amine oxide, stearyl dimethyl amine oxide, dihydroxyethyl lauryl amine oxide, polyoxyethylene coconut oil alkyldimethyl amine oxide, dimethylalkyl (coconut) betaine and dimethyl lauryl betaine. Moreover, as commercially available products of the amphoteric surfactant, for example, those manufactured by Nikko Chemicals Co., Ltd., Nihon-Emulsion Co., Ltd., Nippon Shokubai Co., Ltd., TOHO Chemical Industry Co., Ltd., Kao Corporation, Adeka Corporation, Lion Corporation, Aoki Oil Industrial Co., Ltd., and Sanyo Chemical Industries, Ltd., can be readily available.

The aforementioned various surfactants may be used individually or in combination. A surfactant, which is not easily soluble in the aqueous recording ink, may be soluble when it is added to the aqueous recording ink in combination with other surfactants, and can be stably present in the aqueous recording ink.

The amount of the surfactant contained in the aqueous recording ink is preferably 0.01% by mass to 3% by mass, more preferably 0.5% by mass to 2% by mass. The total amount of the components which have a higher boiling point than that of water and remain as liquid in the aqueous recording ink whose temperature is 25° C. is preferably 20% by mass or less, more preferably 15% by mass or less. When the total amount of the surfactant is less than 0.01% by mass, the effect commensurate with the addition of the surfactant may not be attained. When the total amount of the surfactant is more than 3% by mass, the penetration ability of the ink to recording media may be higher than required, which may cause low image density or strike-through.

The aqueous recording ink preferably contains a carboxyl group-containing resin. When the carboxyl group-containing resin is contained in the aqueous recording ink, the carboxyl group-containing resin reacts with an acid contained in the treatment liquid to cause aggregation of the pigment on a recording medium. Therefore, image density and image quality of the resulting image can be improved.

Examples of the carboxyl group-containing resin include maleic acid resins, styrene-maleic acid resins, rosin-modified maleic acid resins, alkyd resins and modified alkyd resins. Examples of commercially available products thereof include: MALKYD series manufactured by Arakawa Chemical Industries, Ltd.; and HARIMAX series and HARIPHTHAL series, both manufactured by Harima Chemicals, Inc.

The manner of adding the carboxyl group-containing resin may be suitably selected without any restriction. It may be added in the state such that a pigment serving as the colorant is covered with the carboxyl group-containing resin. Alternatively, it may be added separately from the colorant.

—Other Components—

The aqueous recording ink optionally contains saccharides and derivatives thereof. Moreover, the aqueous recording ink optionally contains known penetrating agents, polymer particles, pH regulators, antiseptic/antifungal agents and antirust agents.

—Saccharides and Derivatives Thereof—

Examples of the saccharides include monosaccharides, disaccharides, oligosaccharides (including tri saccharides, and tetra saccharides), polysaccharides, and derivatives thereof. Specific examples thereof include glucose, mannose, fructose, ribose, xylose, trahalose, and maltotriose. Here, "polysaccharide" means sugar in a broad sense, and include compounds widely present in the nature, such as α-cyclodextrin, and cellulose.

Examples of the derivatives of saccharides include reducing sugars of the aforementioned saccharides and oxides of the saccharides. Among them, sugar alcohol is particularly preferable, and specific examples thereof include maltitol and sorbitol.

An amount of the saccharides for use is preferably 0.1% by mass to 40% by mass, more preferably 0.5% by mass to 30% by mass relative to the amount of the aqueous recording ink.

—Penetrating Agent—

As the penetrating agent, a C8-11 polyol compound or glycol ether compound is preferably used. These penetrating agents have an effect of increasing a penetrating speed of the ink to paper as well as an effect of preventing bleeding, and are partially water-soluble compounds having a solubility of 0.1% by mass to 4.5% by mass to water having a temperature of 25° C.

Examples of the C8-11 polyol compound include 2-ethyl-1,3-hexandiol and 2,2,4-trimethyl-1,3-pentandiol.

Examples of the glycol ether compound include polyhydric alcohol alkyl ether compounds and polyhydric alcohol aryl ether compounds.

Examples of the polyhydric alcohol alkyl ether include ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether and propylene glycol monoethyl ether.

Examples of the polyhydric alcohol aryl ether include ethylene glycol monophenyl ether and ethylene glycol monobenzyl ether.

These penetrating agents have a higher boiling point than that of water, and are present as liquid in the ink having a temperature of 25° C. The amount of the penetrating agent contained in the aqueous recording ink is preferably 0% by mass to 10% by mass, more preferably 0.5% by mass to 5% by mass.

—Polymer Particles—

As the polymer particles, those capable of forming a film are used. Here, the phrase "capable of forming a film" means that the polymer particles form a resin film when they are dispersed in water to form an emulsion, and then water is evaporated from the emulsion.

Such polymer particles function to firmly fix the colorant contained in the aqueous recording ink onto a recording medium by forming a film after volatile substances contained in the aqueous recording ink are evaporated. As a result, images excellent in abrasion resistance and water resistance can be formed.

In order to make the polymer particles form a film at room temperature, the lowest film forming temperature thereof is preferably 30° C. or lower, more preferably 10° C. or lower. Here, "the lowest film forming temperature" means the lowest temperature at which a transparent continuous film is formed when polymer emulsion obtained by dispersing the polymer particles in water is thinly applied onto a metal sheet, such as an aluminum sheet, and then the temperature thereof is increased.

The volume average particle diameter of the polymer particles are preferably 5 nm to 200 nm, more preferably 10 nm to 100 nm.

As the polymer particles, particles of a monoparticle structure may be used. For example, if an alkoxysilyl group is contained in an emulsion particle, the alkoxysilyl group is brought into contact with moisture which is left from the fusion of emulsion particles caused by moisture evaporation in the course of coating film formation, and then is hydrolyzed to form a silanol group. If the silanol group remains, the silanol group reacts with an alkoxysilyl group or another silanol group so that a strong crosslinked structure is formed with siloxane bonds. By providing a combination of such reactive functional groups within a polymer particle in this manner, it is possible to form a network structure without using a curing agent by allowing these functional groups to react during film formation.

Moreover, as the polymer particles, polymer particles each having a core-shell structure can be employed. The core-shell structure includes a core and a shell which surrounds the core. The core-shell structure means that two or more polymers each having different formulations are present in each particle in the state of phase separation. Therefore, the core-shell structure includes not only the embodiment such that a shell completely covers a core, but also the embodiment such that a shell partially covers a core. Moreover, part of the polymer of the shell may form domains within a core particle. Furthermore, the core-shell structure may be a multilayer structure of three or more layers which further contains one or more layers, which have different formulations, between the core and the shell.

The polymer particles can be obtained by any method known in the art, such as a method in which unsaturated vinyl monomers (unsaturated vinyl polymers) are emulsion polymerized in water in the presence of a polymerization catalyst and an emulsifier.

The amount of the polymer particles contained in the aqueous recording ink is preferably 0.5% by mass to 20% by mass, more preferably 1% by mass to 5% by mass. When the amount is less than 0.5% by mass, abrasion resistance and water resistance may not be sufficiently improved. When the amount is more than 20% by mass, the jetting performance of the ink becomes unstable because of the increased viscosity of the ink or deposition of the polymer components contained in the ink due to drying, which may cause nozzle clogging.

—pH Regulator—

The aforementioned coloring agent particles (composite pigment particles), in which inorganic particles are each coated with an organic pigment or carbon black, are likely to be acidic when they are mixed and dispersed in water together with an anionic dispersant. Since the anionic dispersant surrounds the surface of the composite pigment dispersed in a medium such as water, it is negatively charged. However, the entire ink is acidic, and thus the medium itself is positively charged. Accordingly, the negative charge on the surface of the particle tends to be neutralized. In such a state, the dispersed particles tend to aggregate, which causes jetting failures. Therefore, it is preferred that the ink be maintained alkaline by adding a pH regulator to stabilize the dispersed state and jetting performance.

The pH value of the aqueous recording ink is preferably 9 to 11. When the pH value thereof is higher than 11, the ink may dissolve a large amount of the materials forming an inkjet head or ink-supplying unit, which causes problems such as deterioration or leakage of the ink, and a jetting failure.

It is preferable that the pH regulator be previously added to water in which the pigment is to be dispersed together with the dispersant. Also, it is preferable that the pH regulator be added together with additives such as a kneading disperser, a wetting agent and a penetrant. This is because the addition of some pH regulators may adversely affect the dispersed state.

Examples of the pH regulator include alcohol amines, alkali metal hydroxides, ammonium hydroxides, phosphonium hydroxides and alkali metal carbonates.

Examples of the alcohol amine include diethanol amine, triethanol amine and 2-amino-2-ethyl-1,3-propandiol.

Examples of the alkali metal hydroxide include lithium hydroxide, sodium hydroxide and potassium hydroxide.

Examples of the ammonium hydroxide include ammonium hydroxide, quaternary ammonium hydroxide and quaternary phosphonium hydroxide.

Examples of the alkali metal carbonate include lithium carbonate, sodium carbonate and potassium carbonate.

—Antiseptic/Antifungal Agent—

Examples of the antiseptic/antifungal agent include sodium dehydroacetate, sodium sorbate, sodium 2-pyridinethiol-1-oxide, sodium benzoate and sodium pentachlorophenol.

—Antirust Agent—

Examples of the antirust agent include acid sulfite, sodium thiosulfate, ammonium thiodiglycolate, diisopropyl ammonium nitrite, pentaerythritol tetranitrate and dicyclohexyl ammonium nitrite.

<Treatment Step>

The treatment step is appropriately selected depending on the intended purpose without any restriction, provided that it is treating a surface of a recording medium with the first pretreatment liquid, and optionally the second pretreatment liquid.

The recording medium for use is appropriately selected depending on the intended purpose without any restriction.

<Image Forming Step>

The image forming step is appropriately selected depending on the intended purpose without any restriction, provided that it is ejecting the aqueous recording ink from a liquid ejecting device to form an image.

The liquid ejecting device is appropriately selected depending on the intended purpose without any restriction, and examples thereof include an image forming unit configured to form an image in an inkjet system.

(Pretreatment Liquid Set)

The pretreatment liquid set of the present invention contains the first pretreatment liquid and the second pretreatment liquid in combination, and used in the aforementioned image forming method.

(Cartridge)

A cartridge of the present invention contains a container, and the pretreatment liquid set housed in the container.

The pretreatment liquid is used as a set including the first pretreatment liquid and the second pretreatment liquid, and this pretreatment liquid set is housed in a container to use as a cartridge. The cartridge may be formed of a container housing therein only the first pretreatment liquid. Moreover, the cartridge may contain other members, if necessary.

Regarding the container, the shape, structure, size, and material thereof are appropriately selected depending on the intended purpose without any restriction. Examples thereof include: a plastic container; and an ink bag formed of an aluminum laminate film, resin film, or the like.

Figure 5:
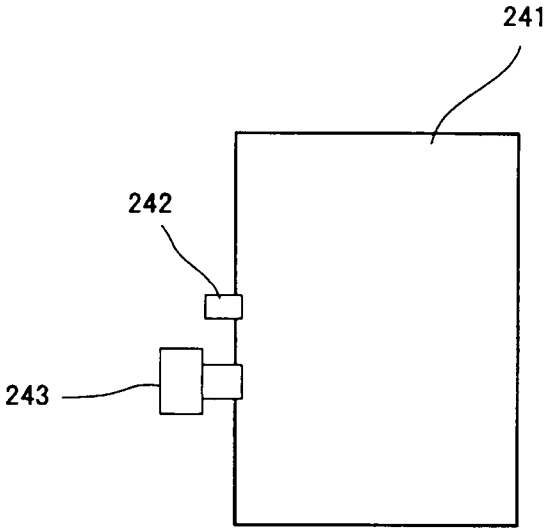
FIG. 5 is a diagram showing one example of an ink cartridge.
Figure 6:
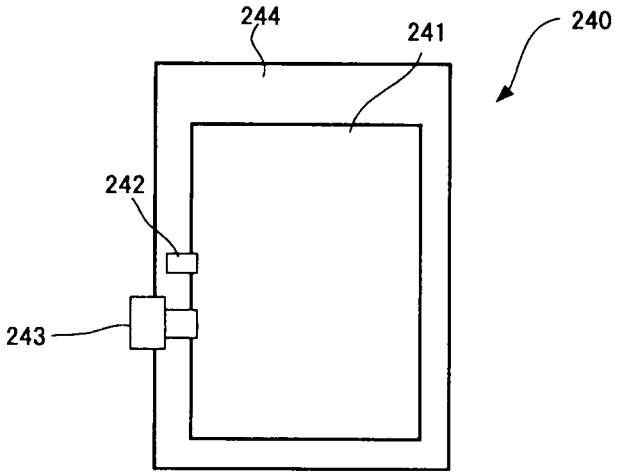
FIG. 6 is a diagram including a casing (an outer package) of the ink cartridge shown in FIG. 5.

Specific examples thereof include those having the similar structure to that of the ink cartridge shown in FIG. 5 or 6, which will be described below. FIG. 5 is a diagram illustrating one example of an ink cartridge, and FIG. 6 is a diagram illustrating the ink cartridge of FIG. 5 as well as a casing (outer package) thereof.

As shown in FIG. 5, the aqueous recording ink is generally introduced into an ink bag 241 from an ink inlet 242. After removing the inner gas from the ink bag, the ink inlet 242 is closed by fusing. For use, the ink cartridge is set in the device by inserting a needle equipped with the body of the device into an ink outlet 243 formed of a rubber member to supply the treatment liquid to the device. The ink bag 241 is formed of an airtight wrapping member such as an aluminum laminate film. As shown in FIG. 6, this ink bag 241 is accommodated in the cartridge case 244 generally made of plastic, and as the treatment liquid cartridge 240, it is detachably mounted to various image forming apparatuses.

Moreover, when, a pretreatment liquid, instead of the ink, is placed in the aforementioned ink cartridge 240, the cartridge can be used as a cartridge for the pretreatment liquid. In this case, the pretreatment liquid cartridge can be also detachably mounted to various image forming apparatuses, similar to the ink cartridge.

To perform the image forming method of the present invention, an image forming device can be used. The image forming device used for perform the image forming method of the present invention contains: an image forming unit configured to form an image on a surface of a recording medium by an inkjet recording system; a reservoir unit configured to reserve the first pretreatment liquid and the pretreatment liquid; and a treatment unit configured to treat the surface of the recording medium with the first treatment liquid and the second treatment liquid before the image formation by the image forming unit. Moreover, the image forming unit contains at least an inkjet unit, and may further contain other units such as a stimulation generating unit, and a control unit, if necessary.

FIG. 1 is a schematic diagram (a side plane explanatory diagram) showing an example of the image forming device.

The image forming device 101 is equipped with head units 110K, 110C, 110M, and 110Y each integrating a head for jetting an ink, maintenance units 111K, 111C, 111M, and 111Y, respectively corresponding to each head unit, ink cartridges 107K, 107C, 107M, and 107Y for supplying an ink, and sub ink tanks 108K, 108C, 108M, and 108Y each storing part of the ink from the respective cartridge and supplying the ink to the respective head with appropriate pressure.

The image forming device 101 further contains: a conveyance belt 113 for conveying a recording medium 114 by sticking the recording medium 114 thereon by means of a suction fan 120; conveying rollers 119, and 121 for supporting the conveyance belt 113; a tension roller 115 for controlling that the conveyance belt 113 maintains an appropriate tension; a platen 124 and platen roller 118 used so that the conveyance belt 113 maintains an appropriate flatness; a charging roller 116 for applying electrostatic charge for sticking the recording medium 114; a discharging roller 117 for pressing the recording medium 114; a paper discharging mechanism composed of a discharging tray 104 for storing the discharged recording media 114; a paper feeding tray 103 for storing the recording media 114 to be printed: a separation pad 112 for sending the recording media 114 one by one from the paper feeding tray; a counter roller 123 for surely sticking the sent recording medium 114 to the charging belt; and a paper feeding mechanism composed of a manual bypass tray 105 used when a paper is manually fed.

Furthermore, the image forming device 101 is also equipped with a discharged liquid tank 109 for collecting waste liquid discharged after maintenance, and a control panel 106 capable of operating the device and displaying the state of the device.

A nozzle array of each head unit is aligned so as to be orthogonal to the conveyance direction of the recording medium 114, and is formed so as to be longer than a length of a recording region. The recording media 114 stored in the paper feeding tray are separated into one piece by a separation roller, and the separated recording medium 114 is fixed onto the conveyance belt by being pressed on the conveyance belt by a pressurize roller. When the recording medium 114 is passed under the head unit, the recording medium 114 is patterned with droplets at high speed by jetting droplets to the recording medium 114. The recording medium 114 is then separated from the conveyance belt by a separation craw, and discharged as a recorded matter into a paper-discharging tray by a discharging roller and another discharging roller.

To this device, a coating system is provided as a system for treating a surface of a recording medium with a pretreatment liquid, and uses roller coating. The pretreatment liquid 135 is taken out to a surface of a roller by a fountain roller 137 from a pretreatment liquid storage tank 140 through a channel not shown in the diagram, and is transferred to a film thickness controlling roller 138. The pretreatment liquid then transferred to an application roller 136 is transferred and applied to the recording medium 114 which is passed between the application roller 136 and a counter roller for application 139.

An amount of the pretreatment liquid transferred to the application roller 136 is controlled by adjusting nip with the application roller 136. When an application of the pretreatment liquid is not desirable, the pretreatment liquid present on a surface of the application roller can be scraped by pressurizing a movable blade 134 against the application roller 136 so as not to leave the pretreatment liquid on the application roller 136. In this manner, functional disorders caused by the remained pretreatment liquid on the application roller 136 (e.g. increased viscosity due to the dried pretreatment liquid, bonding to the counter roller for application 139, and uneven application) can be prevented in advance.

Moreover, as shown in FIG. 1, one paper feeding section may be provided at the upper part of the device and another may be provided at the bottom part, and a method in which the bottom paper feeding section is used in the case where the pretreatment liquid is applied, and the upper paper feeding section is used in the case where the pretreatment liquid is not applied may be used.

Other than the aforementioned roller coating, the pretreatment liquid can also be spray-coated by an inkjet system. For example, the pretreatment liquid is charged in a head having the similar configuration to that of 110K, and then jetted to a recording medium 114 in the same manner as when the ink is jetted. The control of the jetting amount or position can be easily and accurately controlled by this system. Moreover, the roller coating and spray coating may be used in combination.

Whichever system is used, the pretreatment liquid can be applied to a desired location in a desired amount.

Figure 3:
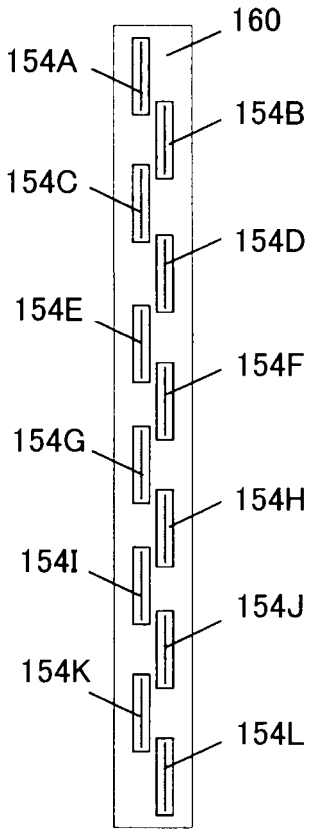
FIG. 3 is a schematic diagram showing one example of a head array in a head unit of an image forming device.

FIG. 3 is a schematic diagram showing one example of the head array in the head unit of the aforementioned image forming device.

The head unit contains heads 154A to 154L fixed on a head circumferential member 160, and the heads are fixed with a staggered arrangement so that the heads overlap with part of nozzle.

Figure 4:
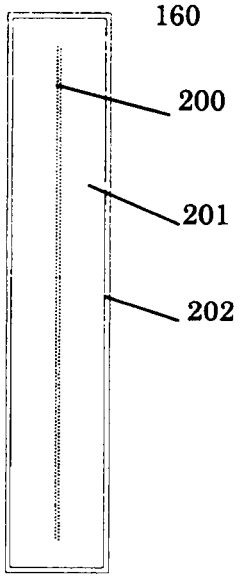
FIG. 4 is an enlarged schematic diagram illustrating a head aligned in the head unit shown in FIG. 3.

FIG. 4 is a schematic diagram showing the enlarged heads aligned in the head unit of FIG. 3. Each head has a nozzle 200 which is two arrays of openings provided in a nozzle plate 201 in a staggered arrangement. The head and the heat circumferential member are sealed with a filler 202 to remove any space on the nozzle surface.

Figure 2:
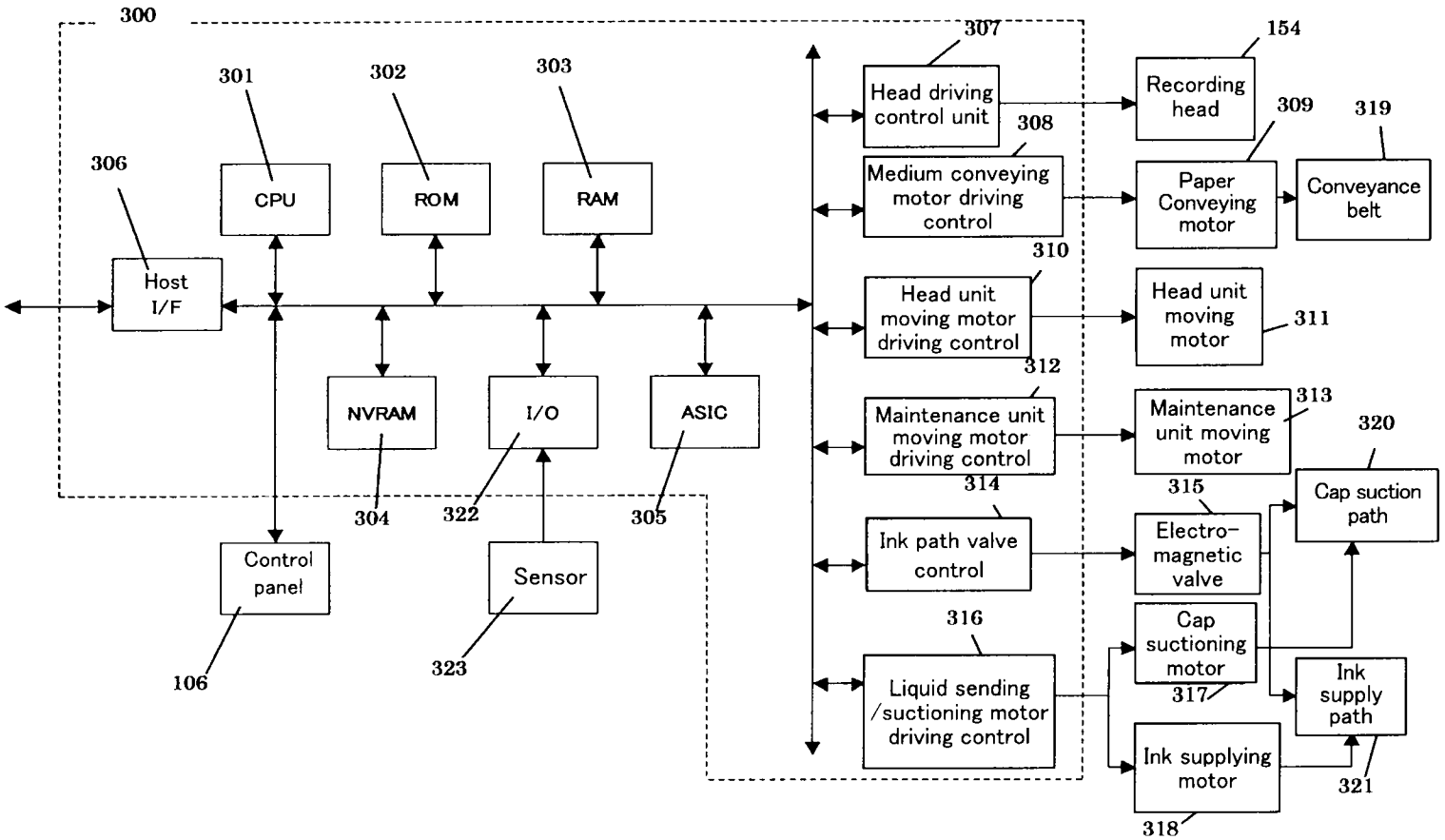
FIG. 2 is a schematic block explanatory diagram illustrating an outline of a control unit of an image forming device.

The outline of the control unit of the image forming apparatus shown in FIG. 1 will be next described with reference to FIG. 2. Note that, FIG. 2 is a schematic block explanatory diagram of the control unit.

The control unit 300 contains: CPU 301 for controlling the entire device; ROM 302 for storing a program CPU 301 executes, and fixed data such as a value for a contamination degree of a nozzle surface relative to an ejection of the ink used in the present invention, a threshold value for the contamination degree of the nozzle surface, and data for a driving wave; RAM 303 for temporarily storing image data and the like; a nonvolatile memory (NVRAM) 304 for keeping data while a power source of the device is shut out; and ASIC 305 for processing input/output signals, such as various signals for the image data and image processing for replacing positions of images, and other input/output signals for controlling the entire device.

Moreover, the control unit 300 contains: a host I/F 306 for sending and receiving data and signals to and from a host; a head drive controlling unit 307 for generating a drive wave for driving and controlling a pressure generating unit of the recording head 154; a recording medium conveying motor driving unit 308 for driving a recording medium conveying motor 309; a head unit moving motor drive controlling unit 310 for driving a head unit (carriage) moving motor 311 and a maintenance unit moving motor drive controlling unit 312 for driving a maintenance unit moving motor 313; an ink channel valve controlling unit 314 for controlling opening and closing of an electromagnetic valve 315 of an ink channel; a delivery/suction motor drive controlling unit 316 for controlling driving of a cap suction motor 317 or ink supplying motor 318; and I/O 322 for inputting detecting signals from an encoder which outputs a detecting signal corresponding to a traveling amount and speed of the conveyance belt 113, detecting signals from a sensor 323 for detecting temperature and humidity environment (or can be either of them), detecting signals on the ink level of each subtank, and detecting signals from various sensors not shown in the diagram. The control unit 300 is connected to a control panel 106 to or on which information necessary to the device is input or displayed. Other than the above, a cap suction channel 320 and an ink supplying channel 321 are provided.

The control unit 300 receives at the host I/F 306 printing data and the like from a host via a cable or net, and in this case the host is such as an information-processing device (e.g., a personal computer), an image scanning device (e.g., an image scanner), and an imaging device (e.g., a digital camera).

CPU 301 reads out printing data into a receiving buffer contained in the host I/F 306 and analyzes the data, optionally makes the data to image-processed or repositioned by ASIC 305, synchronizes the image data (i.e. dot pattern data) which equivalent of one page for a head width of the recording head with respect to a clock signal, and output the signal to the head drive controlling unit 307.

Then, CPU 301 reads out printing data in the receiving buffer contained in the host I/F 306 and analyzes it. After carrying out necessary image processing or repositioning of the data by ASIC 305, the image data is output to the head drive controlling unit 307. Note that, the formation of the dot pattern data for image output may be stored as font data in, for example, ROM 302. Alternatively, the image data may be expanded to bit map data by a printer driver at the host side, and the bit map data may be output to the device.

The head drive controlling unit 307 selectively applies voltage to a pressure generating unit of the recording head based on the image data (i.e., the dot pattern data) for one page of the recording head input per page, and drives the recording head.

Although it is not shown in the diagram, in the case where the treatment liquid is coated by a roller, a control unit of a motor for application, a motor to be controlled, and a sensor for controlling are provided in the device, as it is necessary to control driving of a group of rollers for application, such as an application roller.

Furthermore, in the case where the pretreatment liquid is applied by an inkjet method, there is a possibility to cause nozzle clogging due to mixing with other colors, unless the maintenance operation is performed in a different manner from that of the other inks. Therefore, it is desirable that a maintenance unit moving motor is provided for the pretreatment liquid, separately from that for the ink.

Figure 7:
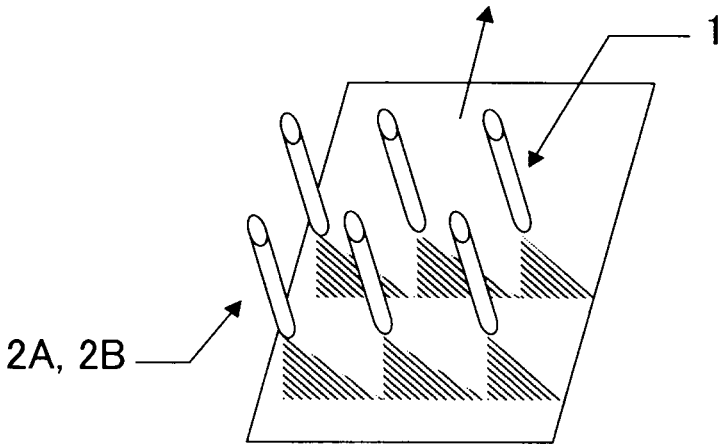
FIG. 7 is a diagram for explaining a coating mechanism of a pretreatment liquid (using an ejection system from an ejection head).
Figure 8:
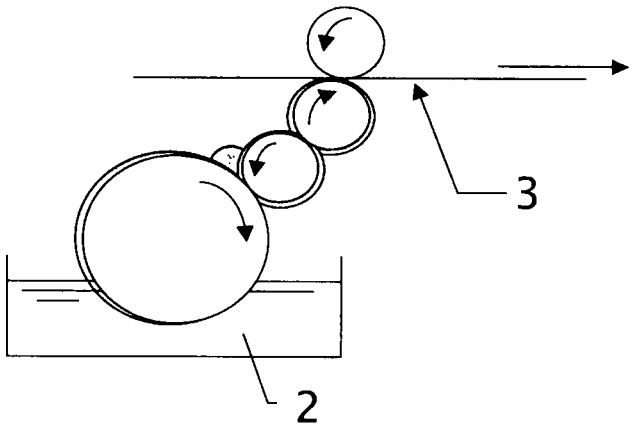
FIG. 8 is a diagram for explaining a coating mechanism of a pretreatment liquid (in a coating system using three rollers).
Figure 9:
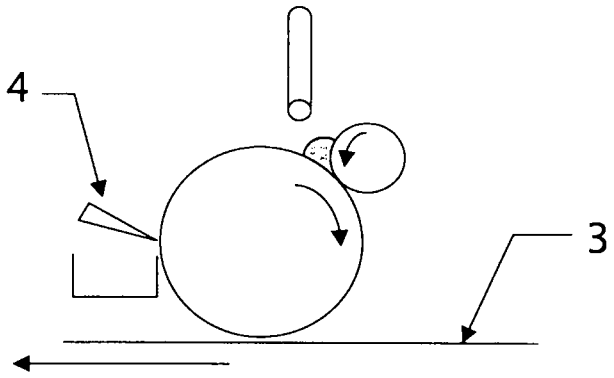
FIG. 9 is a diagram for explaining a coating mechanism of a pretreatment liquid (in a coating system using two rollers).

Examples of a mechanism for coating the pretreatment liquid include a system for ejecting the pretreatment liquid from an ejection head shown in FIG. 7, a coating system using three rollers shown in FIG. 8, and a coating system using two rollers shown in FIG. 9. Note that, in FIGS. 7 to 9, 1 denotes an aqueous recording ink, 2A and 2B respectively denote a first pretreatment liquid and a second pretreatment liquid, 2 denotes a pretreatment liquid, 3 denotes a recording medium, and 4 denotes a scraping blade for the pretreatment liquid.

EXAMPLE

The present invention will be specifically explained with reference to Examples and Comparative Examples hereinafter, but these Examples shall not be construed as limiting the scope of the present invention in any way.

Examples 1 to 14

Comparative Examples 1 to 2

Preparation of Pretreatment Liquid

Materials listed in the respective formulation presented in Table 1 were mixed to prepare first pretreatment liquids A1 to A6. Note that, in the following tables, WS-700 is an oxazoline group-containing acrylic resin manufactured by Nippon Shokubai Co., Ltd. In Table 1, the values presented in the columns of the materials are based on % by mass. Moreover, a number of moles of oxazoline groups contained in the oxazoline group-containing polymer (ox) relative to 1 mol of the acid contained in each pretreatment liquid, and a number of moles of ox in each pretreatment liquid are presented in Table 1.

Moreover, materials of the formulations presented in Tables 2-1 to 2-3 were mixed to respectively prepare the second pretreatment liquids B1 to B14. In Tables 2-1 to 2-3, FS300 denotes a fluorosurfactant manufactured by DIC Corporation. The values in the tables are based on % by mass. Moreover, a number of moles of adipic acid dihydrazide (ADH) in each pretreatment liquid is presented in Tables 2-1 to 2-3.

<Evaluation of Foaming of Pretreatment Liquid>

Each treatment liquid (10 mL) of Tables 1, and 2-1 to 2-3 was placed in a 100 mL-measuring cylinder, and left to stand for one day. Then, the measuring cylinder was placed in a thermostat water bath of 10° C. for 30 minutes or longer so that the liquid temperature was entirely constant. After the liquid temperature had sufficiently become constant, air was blown with a predetermined syringe to generate foam up to 100 mL. After 30 seconds from foam generation, the height (unit: mL) of the foam was visually confirmed. The results are shown in Tables 1, and 2-1 to 2-3.

<Preparation of Aqueous Recording Ink>

Materials of the respective formulation shown in Table 3 were mixed to thereby prepare an aqueous recording ink (Inks 1 to 4). In the Table 3, KM72F is a foam inhibitor manufactured by Shin-Etsu Chemical Co., Ltd., and LV(S) is an antifungal agent manufactured by Avecia Biotechnology Inc. Moreover, a number of moles of adipic acid dihydrazide (ADH) in each ink is presented in Table 3.

<Pretreatment and Image Formation>

The pretreatment liquid A and the pretreatment liquid B were used in combination or independently as shown in the column of each Example or Comparative Example of Tables 4 and 5, and were uniformly applied on a recording medium (MY RECYCLE PAPER GP, manufactured by Ricoh Company Limited) by a wire bar manufactured by Kobayashi Engineering Works, Ltd. (coil diameter: 0.02 mm). In the case where both the pretreatment liquid A and the pretreatment liquid B were applied, the pretreatment liquid A was applied first, and then the pretreatment liquid B was applied.

Then, the aqueous recording ink (Inks 1 to 4) shown in the column of each Example or Comparative Example of Tables 4 to 5 was ejected by means of an image forming device (IPSIO GX5000, manufactured by Ricoh Company Limited) onto the surface of the recording medium to which the pretreatment liquid had been applied based on an image of 3 $cm^2$ formed of a dot-pattern at 30 rpm to thereby obtain a print sample.

Note that, a number of moles of ADH relative to 1 mol of ox in each Example or Comparative Example is shown in Tables 4 to 5.

<Characteristic Evaluations>

Each of the aforementioned printing samples was evaluated in terms of the various characteristics in the following manners. The results are shown in Tables 4 and 5.

—Image Density—

A solid portion of the print sample was measured using a spectrodensitometer (939) manufactured by X-Rite. The samples exhibiting greater values are more preferred.

—Denisty of Transferred Ink—

A solid portion of the print sample was rubbed against a cloth attached onto a clock meter (manufactured by TOYO SEIKI SEISAKU-SHO, LTD.) and the density of the transferred ink on the cloth after rubbing was measured using a spectrodensitometer (939) manufactured by X-Rite. The lower the transfer density, the more preferable the fixing ability of the image.

—Dot Diameter—

An image of each print sample was photographed by a digital microscope VHX-200, manufactured by KEYENCE CORPORATION, and an average value (unit: μm) among twenty measurements of diameters (N=20) was calculated using a dot-diameter analyzing software.

TABLE 1

| | | First pretreatment liquid A | | | | | |
|---|---|---|---|---|---|---|---|
| | | A-1 | A-2 | A-3 | A-4 | A-5 | A-6 |
| Acid | Lactic acid | 5 | 5 | 5 | 5 | 5 | |
| | Ammonium lactate | | | | | | 5 |
| Surfactant | Fluoro-surfactant of formula (1) | 0.15 | 0.15 | 0.15 | 0.15 | 0.15 | 0.15 |

TABLE 1-continued

| | | First pretreatment liquid A | | | | | |
|---|---|---|---|---|---|---|---|
| | | A-1 | A-2 | A-3 | A-4 | A-5 | A-6 |
| Defoaming agent | N-octyl-2-pyrrolidone | 0.35 | 0.35 | 0.35 | 0.35 | 0.35 | 0.35 |
| Crosslinkable resin | WS-700 (oxazoline group-containing polymer) | | 2.7 | 5.0 | 13.7 | 19.2 | 5 |
| Water | Highly pure water | 94.5 | 91.8 | 89.5 | 80.8 | 75.3 | 89.5 |
| Total | | 100 | 100 | 100 | 100 | 100 | 100 |
| Height of foam after 30 sec (mL) | | 0 | 0 | 0 | 0 | 0 | 0 |
| Mol number of ox relative to 1 mol of acid | | 0.00 | 0.10 | 0.18 | 0.50 | 0.70 | 0.18 |
| Mol number of ox | | — | 0.0049 | 0.0091 | 0.0249 | 0.0349 | 0.0091 |

TABLE 2-1

| | | Second pretreatment liquid B | | | | |
|---|---|---|---|---|---|---|
| | | B-1 | B-2 | B-3 | B-4 | B-5 |
| Surfactant | FS-300 Fluorosurfactant of Formula (1) | 0.15 | 0.15 | 0.15 | 0.15 | 0.15 |
| Defoaming agent | N-octyl-2-pyrrolidone | 0.35 | 0.35 | 0.35 | 0.35 | 0.35 |
| | 2,4,7,9-tetramethyl decane-4,7-diol | | | | | |
| | 2,5,8,11-tetramethyl dodecane-5,8-diol | | | | | |
| Cross-linkable resin | Adipic acid dihydrazide | 0.1 | 0.2 | 0.3 | 0.4 | 0.5 |
| Water | Highly pure water | 99.4 | 99.3 | 99.2 | 99.1 | 99 |
| Total | | 100 | 100 | 100 | 100 | 100 |
| Height of foam after 30 sec. | | 0 | 0 | 0 | 0 | 0 |
| Mol number of ADH | | 0.0006 | 0.0011 | 0.0017 | 0.0023 | 0.0029 |

TABLE 2-2

| | | Second pretreatment liquid B | | | | |
|---|---|---|---|---|---|---|
| | | B-6 | B-7 | B-8 | B-9 | B-10 |
| Surfactant | FS-300 Fluorosurfactant of Formula (1) | 0.15 | 0.15 | 0.5 | 0.15 | 0.15 |
| Defoaming agent | N-octyl-2-pyrrolidone | 0.35 | 0.35 | | | |
| | 2,4,7,9-tetramethyl decane-4,7-diol | | | | 0.35 | |
| | 2,5,8,11-tetramethyl dodecane-5,8-diol | | | | | 0.35 |
| Cross-linkable resin | Adipic acid dihydrazide | 1 | 2 | 1 | 1 | 1 |
| Water | Highly pure water | 98.5 | 97.5 | 98.5 | 98.5 | 98.5 |
| Total | | 100 | 100 | 100 | 100 | 100 |
| Height of foam after 30 sec. | | 0 | 0 | 90 | 0 | 0 |
| Mol number of ADH | | 0.0057 | 0.0115 | 0.0057 | 0.0057 | 0.0057 |

TABLE 2-3

| | | Second pretreatment liquid B | | | |
|---|---|---|---|---|---|
| | | B-11 | B-12 | B-13 | B-14 |
| Surfactant | FS-300 Fluorosurfactant of Formula (1) | 1.25 | 0.38 | 0.38 | 0.38 |
| Defoaming agent | N-octyl-2-pyrrolidone | | 0.35 | | |
| | 2,4,7,9-tetramethyl decane-4,7-diol | | | 0.35 | |
| | 2,5,8,11-tetramethyl dodecane-5,8-diol | | | | 0.35 |
| Cross-linkable resin | Adipic acid dihydrazide | 1 | 1 | 1 | 1 |
| Water | Highly pure water | 97.75 | 98.28 | 98.28 | 98.28 |
| Total | | 100 | 100 | 100 | 100 |
| Height of foam after 30 sec. | | 90 | 90 | 90 | 90 |
| Mol number of ADH | | 0.0057 | 0.0057 | 0.0057 | 0.0057 |

TABLE 3

| | | Ink-1 | Ink-2 | Ink-3 | Ink-4 |
|---|---|---|---|---|---|
| Pigment dispersion | Black dispersion | 50.0 | 50.0 | 50.0 | 50.0 |
| Wetting agent | Glycerin | 17.0 | 17.0 | 17.0 | 17.0 |
| | 1,3-butanediol | 10.0 | 10.0 | 10.0 | 10.0 |
| Surfactant | FS-300 | 2.5 | 2.5 | 2.5 | 2.5 |
| Penetrating agent | 1,2-octanediol | 2.0 | 2.0 | 2.0 | 2.0 |
| Defoaming agent | KM-72F | 0.1 | 0.1 | 0.1 | 0.1 |
| pH regulator | 2-amino-2-ethyl-1,3-propanediol | 0.5 | 0.5 | 0.5 | 0.5 |
| Antifungus agent | LV (S) | 0.1 | 0.1 | 0.1 | 0.1 |
| Resin | Adipic acid dihydrazide | | 0.1 | 0.3 | 1 |
| Water | Highly pure water | 17.8 | 17.7 | 17.5 | 16.8 |
| Total | | 100 | 100 | 100 | 100 |
| Mol number of ADH | | — | 0.0006 | 0.0017 | 0.0057 |

TABLE 4

| | Comp. Ex. 1 | Comp. Ex. 2 | Ex. 1 | Ex. 2 | Ex. 3 | Ex. 4 | Ex. 5 | Ex. 6 |
|---|---|---|---|---|---|---|---|---|
| Ink | Ink 1 | Ink 1 | Ink 1 | Ink 1 | Ink 1 | Ink 1 | Ink 1 | Ink 1 |
| First pretreatment liquid A | — | A-1 | A-2 | A-3 | A-4 | A-3 | A-3 | A-3 |
| Second pretreatment liquid B | — | — | B-7 | B-7 | B-7 | B-3 | B-4 | B-5 |
| Image density (—) | 1.10 | 1.25 | 1.28 | 1.25 | 1.26 | 1.26 | 1.24 | 1.25 |
| Density of transferred ink (—) | — | 0.255 | 0.173 | 0.171 | 0.182 | 0.207 | 0.185 | 0.174 |
| Dot diameter (μm) | — | 65.8 | 73.1 | 72.9 | 68.7 | 69.8 | 71.3 | 71.8 |
| Mol number of ADH relative to 1 mol of ox | — | — | 2.3 | 1.3 | 0.5 | 0.2 | 0.3 | 0.3 |

TABLE 5

| | Ex. 7 | Ex. 8 | Ex. 9 | Ex. 10 | Ex. 11 | Ex. 12 | Ex. 13 | Ex. 14 |
|---|---|---|---|---|---|---|---|---|
| Ink | Ink 1 | Ink 1 | Ink 1 | Ink 1 | Ink 2 | Ink 3 | Ink 4 | Ink 1 |
| First pretreatment liquid A | A-3 | A-3 | A-3 | A-5 | A-3 | A-3 | A-3 | A-6 |
| Second pretreatment liquid B | B-6 | B-1 | B-2 | B-7 | — | — | — | B-14 |
| Image density (—) | 1.27 | 1.24 | 1.25 | 1.26 | 1.23 | 1.25 | 1.26 | 1.24 |
| Density of transferred ink (—) | 0.17 | 0.216 | 0.214 | 0.237 | 0.219 | 0.209 | 0.176 | 0.168 |
| Dot diameter (μm) | 72.6 | 68.8 | 69.2 | 67.8 | 68.7 | 69.5 | 71.9 | 73.5 |
| Mol number of ADH relative to 1 mol of ox | 0.6 | 0.06 | 0.1 | 0.3 | 0.1 | 0.2 | 0.6 | 1.3 |

From the comparison between Examples and Comparative Examples of the tables above, it was found that the density of the transferred ink was reduced and the fixation of the ink was improved by combining the acid, the oxazoline group-containing polymer and the adipic acid dihydrazide. Moreover, based on the results of Examples 11 to 13, it was found that the similar effect could be attained in the case where the adipic acid dihydrazide was contained in the aqueous recording ink.

Especially in the case where the amount of the oxazoline group-containing polymer for use was 0.5 mol or less of the oxazoline groups in the oxazoline group-containing polymer relative to 1 mol of the acid, and the amount of the adipic acid dihydrazide for use was 0.2 mol or more relative to 1 mol of the oxazoline groups in the oxazoline group-containing polymer (Examples 1 to 7, 13, and 14), excellent results could be attained in all of the image density, density of transferred ink, and dot diameter.

What is claimed is:

1. An image forming method, comprising:

treating a surface of a recording medium with acid, an oxazoline group-containing polymer, and adipic acid dihydrazide;

wherein the treating is treating the surface of the recording medium with a first pretreatment liquid containing the acid and the oxazoline group-containing polymer, and with a second pretreatment liquid containing the adipic acid dihydrazide, and wherein the method further comprises:

ejecting an aqueous recording ink from a liquid ejecting device to form an image on the surface of the recording medium.

2. The image forming method according to claim 1, wherein an amount of the adipic acid dihydrazide for use is 0.2 mol or more relative to 1 mol of oxazoline groups contained in the oxazoline group-containing polymer.

3. The image forming method according to claim 1, wherein an amount of the oxazoline group-containing polymer for use is determined based on an amount of oxazoline groups contained therein, which is 0.5 mol or less relative to 1 mol of the acid.

4. The image forming method according to claim 1, wherein the acid contains a carboxyl group in a molecular structure thereof.

5. The image forming method according to claim 4, wherein the acid is lactic acid.

6. The image forming method according to claim 1, wherein the first pretreatment liquid, the second pretreatment liquid, or both thereof further contains a surfactant.

7. The image forming method according to claim 6, wherein the surfactant is a fluorosurfactant.

8. The image forming method according to claim 7, wherein the fluorosurfactant is a compound expressed by the following formula (1)

$$C_4F_9—CH_2CH(OH)CH_2O—(CH_2CH_2O)_{23}—CH_2CH(OH)CH_2—C_4F_9 \quad \text{Formula (1).}$$

9. The image forming method according to claim 1, wherein the first pretreatment liquid, the second pretreatment liquid, or both thereof further contains a foam inhibitor.

10. The image forming method according to claim 9, wherein the foam inhibitor is at least one selected from the group consisting of N-octyl-2-pyrrolidone, 2,4,7,9-tetramethyldecane-4,7-diol, and 2,5,8,11-tetramethyldodecane-5,8-diol.

* * * * *